US009145649B2

(12) United States Patent
Buschmann et al.

(10) Patent No.: US 9,145,649 B2
(45) Date of Patent: Sep. 29, 2015

(54) PUSHING DEVICE

(75) Inventors: Martin Buschmann, Neustadt (DE); Thomas Schmidt, Plankstadt (DE); Ralf Weiser, Ladenburg (DE)

(73) Assignee: JOSEPH VOGELE AG, Ludwigshafen/Rhein (DE)

( * ) Notice: Subject to any disclaimer, the term of this patent is extended or adjusted under 35 U.S.C. 154(b) by 285 days.

(21) Appl. No.: 13/479,553

(22) Filed: May 24, 2012

(65) Prior Publication Data

US 2012/0299270 A1 Nov. 29, 2012

(30) Foreign Application Priority Data

May 24, 2011 (EP) ..... 11004264

(51) Int. Cl.
*B65G 69/00* (2006.01)
*E01C 19/48* (2006.01)

(52) U.S. Cl.
CPC ..... *E01C 19/48* (2013.01); *E01C 2301/08* (2013.01)

(58) Field of Classification Search
CPC . E01C 2301/02; E01C 2301/08; E01C 19/00; B65G 69/001
USPC ..... 180/19.3; 293/17, DIG. 1; 404/128, 131, 404/133.1
See application file for complete search history.

(56) References Cited

U.S. PATENT DOCUMENTS 497,381 A * 5/1893 Loucks ..... 293/17
592,950 A * 11/1897 Campbell ..... 293/17
1,146,933 A * 7/1915 Gallagher, Jr. ..... 213/29
1,629,224 A * 5/1927 Mohr ..... 213/221
2,646,287 A * 7/1953 Kytola ..... 280/481
2,919,142 A * 12/1959 Winget ..... 280/481
2,986,827 A * 6/1961 Peterson ..... 172/816
3,750,802 A 8/1973 Holland
4,836,578 A * 6/1989 Soltis ..... 280/6.15
4,955,754 A * 9/1990 Smith ..... 404/108
5,004,394 A * 4/1991 Goodwin et al. ..... 414/346
5,100,277 A * 3/1992 Musil ..... 414/334
5,219,259 A * 6/1993 Cochran et al. ..... 414/345
5,269,641 A * 12/1993 Cochran et al. ..... 414/345

(Continued)

FOREIGN PATENT DOCUMENTS

CN 200520051281 7/2005
CN 200520051281 Y 8/2006

(Continued)

OTHER PUBLICATIONS

European Search Report mailed Oct. 21, 2011, which issued in corresponding EP Application Serial No. 11004264.

(Continued)

*Primary Examiner* — Joseph Rocca
*Assistant Examiner* — Gabriela C Craciun
(74) *Attorney, Agent, or Firm* — Fish & Richardson P.C.

(57) ABSTRACT

A pushing device that can be attached to a road paver or feeder vehicle. The pushing device is attachable to a chassis component of the road paver or the feeder vehicle and comprises a pushing unit that is attached in a movable manner to the chassis component by means of at least a spring-absorber unit. The pushing unit can be displaced relative to the chassis component in a first direction and a second direction, whereby the spring-absorber unit has a greater spring rate during a movement of the pushing unit in the first direction than in the second direction.

13 Claims, 4 Drawing Sheets

(56) References Cited

U.S. PATENT DOCUMENTS

| | | | | | |
|---|---|---|---|---|---|
| 5,371,598 | A | * | 12/1994 | Ghaem et al. | 356/617 |
| 5,529,455 | A | * | 6/1996 | Kaster et al. | 414/523 |
| 6,193,437 | B1 | | 2/2001 | Heims | |
| 2005/0077691 | A1 | * | 4/2005 | Witters | 280/5.514 |

FOREIGN PATENT DOCUMENTS

| | | | | |
|---|---|---|---|---|
| DE | 3524463 | | * | 1/1987 |
| DE | 3524463 | A1 | | 1/1987 |
| DE | 3612131 | | * | 10/1987 |
| DE | 3612131 | A1 | | 10/1987 |
| DE | 9203867 | | * | 5/1992 |
| DE | 9203867 | U1 | | 5/1992 |
| DE | 9203902 | U1 | | 7/1992 |
| DE | 9408192 | | * | 9/1994 |
| DE | 9408192 | U1 | | 9/1994 |
| DE | 19513323 | | * | 10/1996 |
| DE | 19513323 | A1 | | 10/1996 |
| DE | 19821090 | A1 | | 12/1999 |
| EP | 0562586 | | * | 9/1993 |
| EP | 0562586 | A2 | | 9/1993 |
| EP | 681514 | | * | 11/1995 |
| EP | 681514 | A1 | | 11/1995 |
| EP | 2295641 | A2 | * | 3/2011 |
| GB | 1135608 | | * | 12/1968 |
| GB | 1135608 | A | | 12/1968 |

OTHER PUBLICATIONS

An official action mailed Aug. 9, 2013, which issued in corresponding European Application No. 11004264.5.

* cited by examiner

PUSHING DEVICE

BACKGROUND OF THE INVENTION

The present invention relates to a pushing device and to a vehicle for receiving installation or paving material, particularly a road paver or feeder vehicle During the installation of pavements, a heavy goods vehicle (HGV) loads road pavers or feeders with the material that is to be installed. The material is thereby tipped by the HGV directly into the hopper of the road paver or of the feeder.

To transfer the material, a loaded HGV slowly drives backwards to the vehicle that is to be loaded, stops a short distance away from the vehicle and waits until the approaching paver or feeder is docked to the chassis of the HGV by means of a pushing device. In most cases, the pushing device docks to the rear tires of the HGV. After the docking process, the road paver or feeder accelerates the HGV from a standing position to the installation speed and pushes said HGV in front of itself until such a time as the HGV has been fully unloaded.

The docking to the road paver or the feeder, and also the drive together along the installation route, while the material is being dumped into the hopper greatly depend on the routine of the HGV driver. In this situation, however, it frequently happens that serious installation mistakes are made because the HGV driver applies the brakes of the HGV for too long and/or with too much force. This can lead to a delayed drive of the pushing vehicle, as a result of which installation errors occur in the pavement. Pushing the HGV also squanders energy in order to maintain the installation speed.

On the other hand, the HGV driver is not permitted to release the brake of the HGV completely, because otherwise the HGV would be pushed away towards the front due to the effect of the momentum of the material sliding out. Consequently, the material that slides out would no longer land in the hopper of the road paver or feeder and would instead fall in front of the vehicle.

For this reason, an HGV driver should be able to balance the braking force on the HGV sensitively against the push of the road paver or feeder so that no damage results in the pavement and so that the road-building material lands on target in the hopper.

In a further situation with regard to the material transfer, the HGV does not remain in front of the road paver or feeder, and instead slowly drives backwards against a pushing device of the respective vehicle. It is important thereby that the HGV does not collide against the road paver or feeder in an abrupt manner, which would namely result in the vehicle that is to be supplied being displaced in a jerky manner in a direction opposite to the installation direction, which would lead to damage in the new roadway surface. The HGV that is driving backwards must therefore be delayed until it comes to a standstill by means of a pushing device. It is also important thereby that the HGV is driven against the pushing device of the road paver or feeder with a great deal of routine. There is a risk, however, that the HGV collides against the pushing device too quickly, or that the HGV driver drives against the pushing device for too long, which can lead to a displacement of the paver and in this way to unwanted line-shaped imprints in the roadway surface.

Most of the known pushing devices are bars in a floating mount with push rollers on the ends, whereby the pushing devices are rigidly connected to the paver frame. In some cases, the bars can also be manually or automatically adjusted in the driving direction. When the push rollers dock against the HGV tires, the HGV tires deform elastically and thereby store deformation energy. Even in the case of small acceleration paths or brake paths, the acceleration levels rise strongly, as do consequently the dynamic forces between the HGV and the paver or feeder. The success of the drive or braking procedure is also thereby very strongly dependent on the skill of the HGV driver. For this reason, there is often someone giving directions in front of the road paver in order to support the HGV driver in the docking.

Also known are pushing devices which support the push rollers individually or in groups by means of coil springs or hydraulic cylinders. Such alternatives have greater movement possibilities for the pushing device especially during docking. Pushing devices with coil springs, however, have the disadvantage that as a result of the deformation, they store energy that would tend to accelerate the HGV away from the paver again after the docking. This can happen in a jerky manner, as a result of which the emptied, lighter HGV again loses contact with the road paver or feeder. During renewed docking, it is thereby possible that damage results to the pavement.

In contrast, hydraulic systems have greater flexibility with respect to absorption and spring characteristics. In these cases, however, the high level of complexity is disadvantageous, whereby there is also additional energy consumption in the case of actively controlled hydraulic systems.

U.S. Pat. No. 5,100,277 A describes a material transfer system for a road paver. A road paver, a material-supplying HGV and a feeder arranged between the road paver and the HGV are provided for the material transfer system. The material-supplying HGV is thereby docked against a hydraulic advancing device of the feeder vehicle in order subsequently to unload material. The hydraulic pushing device can be controlled by a hydraulic pump.

DE 920 39 02 U1 refers to a road construction vehicle with an extendible support unit. From the driver's cabin, it is possible to use the extendible support unit to regulate the distance between the road construction vehicle and a transport vehicle that is being pushed at the front.

DE 94 08 192 U1 describes a road paver with a storage container and push rollers that are attached to a cross-arm with mountings and that are arranged in front of the storage container.

U.S. Pat. No. 5,004,394 A describes a pushing device that is arranged on a road paver vehicle or on a feeder, whereby the pushing device is mounted on a cross-arm in a resilient manner by means of springs or hydraulic cylinders.

DE 92 038 67 U1 refers to a pushing device for a road construction vehicle, whereby the pushing device comprises adjustable ejector rollers that can be extended crosswise with respect to the driving direction in order to change the width of the pushing device.

DE 195 13 323 A1 describes a road paver with one or more coaxial push rollers that are mounted in a rotatable manner by means of a pendulum cross-arm.

EP 2 295 641 A2 describes a construction machine with push rollers mounted on the chassis and supported by hydraulic cylinders. A pressure limiting valve is provided in order to cushion the push rollers when an HGV collides into them. This, however, has the technical disadvantage that the pressure limiting valve remains closed up to a certain pressure rise and as a result stores energy, which can lead to an agitated pushing of the HGV. In addition, it is difficult to regulate the speed of the paver at the moment at which the pressure limiting valve opens.

U.S. Pat. No. 4,955,754 A describes a pushing device for a road paver that comprises a hydraulically activated cushioning device with a floating mounting. An HGV that is driving backwards can be cushioned with the hydraulically activated cushioning device.

DE 198 21 090 A1 relates to a road paver vehicle with a pendulum cross-arm, whereby a feeder vehicle driving backwards towards a half of a bucket of the road paver vehicle comes into contact with the respective pendulum cross-arm, at which point the feeding can begin.

DE 35 24 463 A1 describes a vehicle for the continuous feeding of a road paver, whereby the vehicle comprises support rollers against which an unloading supply vehicle can dock with its rear wheels.

DE 36 12 131 A1 describes a road surface paver with push rollers that press against rear vehicle wheels of a heavy goods vehicle when this loads the road surface paver with a mixture.

CN 200520051281.X relates to a pushing device that is mounted to a road construction vehicle, whereby the pushing device comprises a cushioning mechanism with coil springs.

SUMMARY OF THE INVENTION

In light of the above problems in practical application and the known state of the art, the object of the present invention is, using simple technical design features, to create an improved pushing device that is simple to mount to a road paver or feeder and that allows a cushioning docking or undocking with respect to a material supply vehicle, so that no installation errors result in the pavement.

This object is solved by the pushing device and the vehicle for receiving installation or paving material of the present invention The present invention relates to a pushing device that can, in particular, be mounted or provided to a road paver or feeder. The pushing device is formed in order to dock to an HGV in a cushioned manner and to push this HGV in front of itself at a constant distance. The HGV can be docked to the pushing device both from a standstill or while moving.

The pushing device according to the invention comprises at least a pushing unit, whereby the pushing unit is movably mounted relative to a chassis component, such as a cross-arm, for example, that is arranged on the road paver or feeder, by means of at least a cushioning spring-absorber unit. The cushioning spring-absorber unit is capable of absorbing a force due to the pushing unit mounted thereupon when an HGV docks on the pushing unit and pushes the pushing unit in a first direction onto the cross-arm. The spring-absorber unit can thereby be displaced from a first position into a second position, as a result of which an absorption of energy takes place in the spring-absorber unit. The spring-absorber unit can then remain in the second position until the docked HGV drives away. During the installation phase, when the HGV is pushed in front of the pushing device, the second position of the spring-absorber unit can also vary slightly, however. By means of the stored energy, i.e. by means of the spring effect, the pushing unit can be displaced into an opposite second direction when the HGV is driving away, which results in the spring-absorber unit being transferred from the second position back into the first position. As a result, the pushing unit is pressed away from the cross-arm again by means of the spring-absorber unit. According to the invention, it is provided that the spring-absorber unit has a larger spring rate during a movement of the pushing unit in the first direction than in the second direction. The spring rate refers to the spring constant or the spring stiffness.

It is advantageous that due to the softer spring rate during the spring release of the spring-absorber unit in the second direction, a smaller force acts than during the spring compression in the first direction. As a result, the energy stored in the spring-absorber unit is not fully discharged on to the HGV that is to be pushed, with only a portion of said energy being discharged in this way. Consequently only a necessary pushing force acts on the HGV, which is sufficient for maintaining an essentially constant distance between the HGV and the road paver or feeder.

In addition, during a docked drive, it is possible as a result of the reduced force acting on the HGV, i.e. the reduced spring rate, to avoid having the HGV accelerate away due to uneven activation of the HGV brakes.

The spring-absorber unit according to the invention also makes it possible for an unloading HGV that is being pushed in front to be smoothly pushed in front of the absorber device. This is possible because the spring-absorber unit makes only slight, if any, changes with regard to its position due to the larger, harder spring rate during the spring compression, and does not react sensitively to the braking behaviour or to the speed of the HGV.

Furthermore, due to the hard spring compression, it is not possible that the HGV that is to be pushed in front overloads the spring-absorber unit, whereby overstretching of the spring-absorber unit is meant by this. This could namely lead to an abrupt collision against the road paver or feeder, as a result of which damage to the pavement would be probable.

The spring-absorber unit preferably comprises at least a friction spring. Due to the friction spring, it is especially easy to achieve a higher spring rate during the spring compression of the spring-absorber unit than during the spring release. The counteracting friction force can be advantageously exploited thereby during the spring compression and during the spring release. While a large force is needed on the spring-absorber unit during the spring compression in order to overcome the opposing friction force in order to bring the spring-absorber unit into the second position, a lower force results in the opposite direction in order to transfer the spring-absorber unit from the second position back into the first position, because a portion of the stored force is absorbed for overcoming the applied friction.

The cross-arm is preferably welded on to the chassis of the road paver or feeder vehicle. This makes possible an especially robust manner of attaching the cross-arm, so that the cross-arm remains solidly held even after multiple dockings of an HGV. The welded-on cross-arm furthermore offers a stable base to which the pushing unit can be attached. It would also be conceivable, however, for the cross-arm to be detachably attached to the chassis. In this way, it would be possible to exchange the cross-arm easily should signs of wear and tear arise. The cross-arm could then likewise be exchanged according to the particular application, for example, with a lighter or heavier cross-arm.

It would also be possible for the spring-absorber unit to be attached to the cross-arm and/or the chassis of the road paver or feeder vehicle in a detachable or non-detachable manner. In the case of the detachable variant, the spring-absorber unit could be quickly and simply removed from the road paver or feeder for maintenance purposes. A detachable spring-absorber unit likewise offers the advantage that it could be used on other vehicles. A non-detachable attachment of the spring-absorber unit to the cross-arm would particularly produce advantages with regard to stability and robustness. With the non-detachable connection of the spring-absorber unit to the cross-arm, the cross-arm is itself seen as a part of the pushing device, which would preferably result in the cross-arm being detachably attachable to the chassis.

In a further embodiment of the invention, the hardness of the spring rate of the spring-absorber unit is variably adjustable. This consequently makes it possible to match the spring rate to the expected weight of the HGV that is to be pushed.

In a further embodiment of the invention, the spring-absorber unit is connected to the pushing unit by means of a movable articulated joint. It is also advantageous if the articulated joint allows a skewed position of the pushing unit relative to the cross-arm, so that the pushing unit can be essentially horizontally displaced with respect to the installation surface. In this way, a material supply vehicle that drives up in a skewed alignment can succeed as well as one that approaches straight on. The pushing unit that can be displaced in a skewed manner can furthermore compensate for a driving direction of the HGV that is being pushed ahead, so that small changes in the HGV driving direction do not lead to an uneven stress on the pushing device.

The pushing unit preferably comprises a first section, which is attached to an outer first section of the cross-arm by means of at least a spring-absorber unit, whereby the pushing unit comprises a second section that is attached to an outer, opposite section of the cross-arm by at least a spring-absorber unit. The two spring-absorber units are thereby mounted separately from each other and can preferably be moved independently of each other, whereby an independent skewed position is likewise possible. The two sections of the pushing unit provide selective absorption and forward pushing of a docking material supply vehicle and can smoothly push the docked material supply vehicle ahead of themselves.

The pushing unit is executed in an especially stable manner if the first and the second section have a rigid connection to each other by means of a middle section. This produces a robust pushing bar that is particularly well suited for pushing against heavy material supply vehicles.

In a further embodiment of the invention, the pushing bar is mounted to the cross-arm only in the middle by means of the spring-absorber unit, whereby the spring-absorber unit allows both a linear movement of the pushing bar towards the cross-arm and also a skewed position of the pushing bar. If the pushing bar is mounted only in the middle by means of the spring-absorber unit, then preferably additional adsorbing elements are present on the outer sections of the pushing bar and/or on the outer sections of the cross-arm that do not allow the pushing bar to collide against the cross-arm when said bar is in a skewed position. For example, the adsorbing elements are formed from plastic or rubber.

In another embodiment of the invention, the pushing bar comprises a guide section in the middle that is formed in such a way that it holds in a movable manner an alignment protrusion of the cross-arm in between. The usually heavy pushing bar can consequently be stably held and guided, whereby it is fixed in place in the vertical direction.

Preferably at least a docking element is held on the pushing unit, whereby said docking element comes into contact with the approaching vehicle during docking and allows the supply vehicle to be pushed ahead without jerking. The docking element is preferably a rotatably mounted push roller with which the docked material supply vehicle can be pushed forward in a manner that is especially free of jerking.

For reliable crane loading, attachment elements that are formed as suspension eyes could be provided on the cross-arm. It is likewise conceivable that the cross-arm can be easily mounted to a road paver vehicle or to a feeder by means of the attachment elements. The attachment elements can, for example, also be formed as attachment links that can be attached to the chassis by means of a screwed connection. It is also conceivable that the attachment elements are formed for the purpose of holding the pushing device in a manner that allows the height to be adjusted. A height adjustment of the pushing device could be implemented manually or automatically, for example, by means of hydraulic cylinders that act as the means of attachment.

In a further embodiment of the invention, the pushing device comprises at least a sensor that is integrated into at least a spring-absorber unit that is provided for the pushing unit. The sensor can be formed as a capacitive, inductive, resistive or infrared sensor that is capable of acquiring a movement or a position accurately. The sensor is preferably formed for acquiring the position of the spring-absorber unit and/or for acquiring a distance between the cross-arm and the pushing unit. The sensor can also be formed for real-time acquisition.

Finally, the sensor is preferably coupled to a controller, whereby the sensor is formed for the purpose of acquiring the entire range of the spring or individual spring positions in the spring-absorber unit and, using the acquired values, to provide signals to the controller. The controller is preferably formed for the purpose of evaluating the signals with quick reactions and, depending on the embodiment, to output acoustic or visual warning signals using means provided for this purpose in order to provide information on the docking situation between the road paver and the docking HGV. For example, this can take place by means of a horn and/or traffic light display that is connected to the controller. These means that are provided for giving a warning make it possible to do without someone giving instructions. It thereby depends on the embodiment as to whether the means for providing the warning are provided directly on the pushing device or in the drivers cabin of the road paver.

BRIEF DESCRIPTION OF THE DRAWINGS

Embodiments of the object of the invention are explained using the drawings. Shown are.

DETAILED DESCRIPTION OF THE INVENTION

Figure 1:
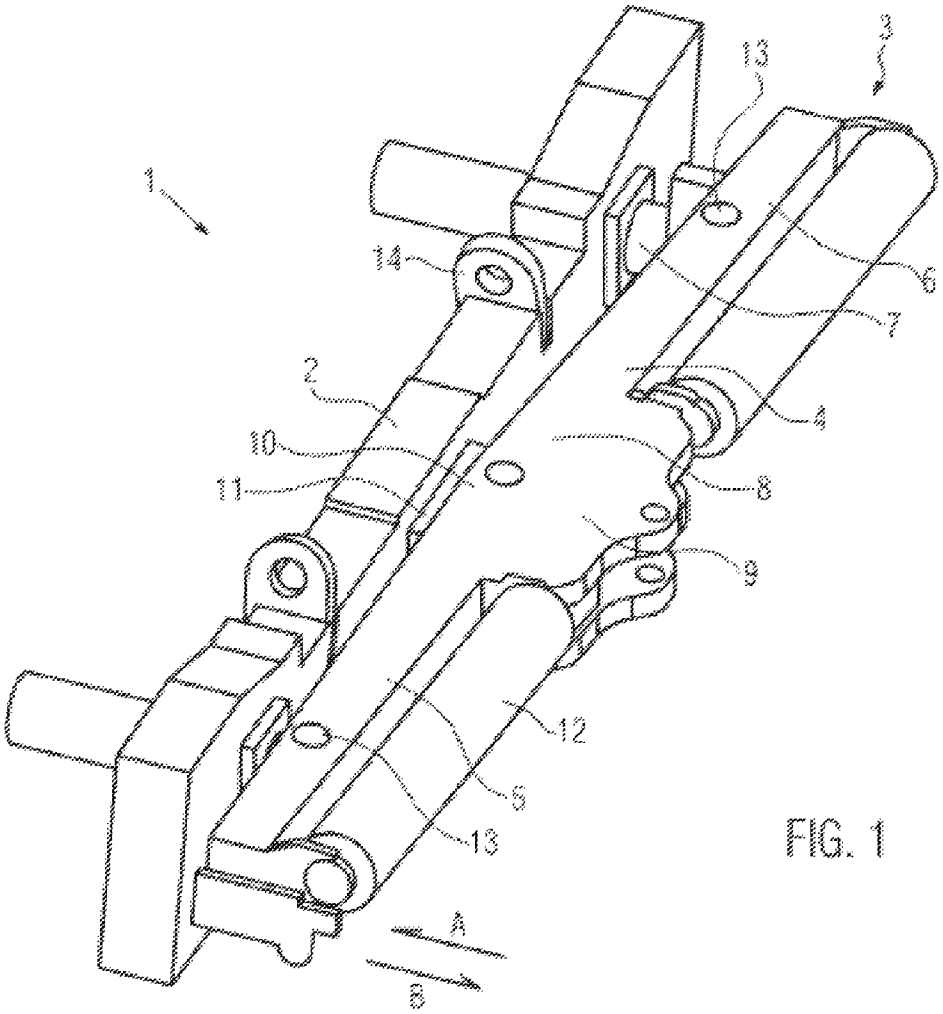
FIG. 1 a depiction of the pushing device according to the invention.
Figure 2:
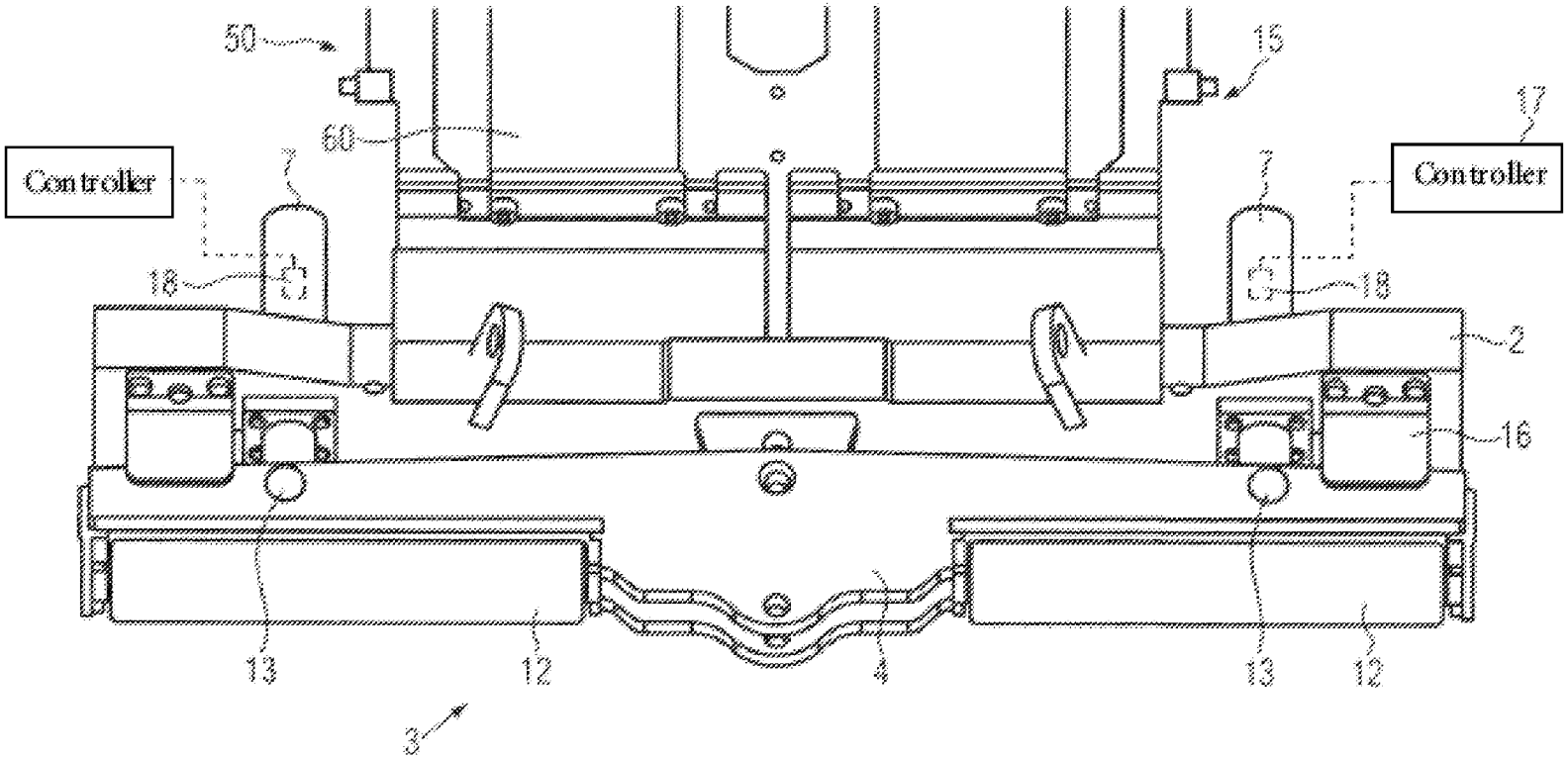
FIG. 2 a depiction of the pushing device according to the invention relative to a material hopper end of a road paver or feeder, FIG. 3 a force-displacement diagram for the spring-absorber unit, FIG. 4 a force curve during and after the docking procedure, and FIG. 5 a sectional representation of a friction spring.

FIG. 1 shows a pushing device 1 that can be attached to a road paver or feeder vehicle 50 (see FIG. 2). The pushing device 1 comprises a pushing unit 3 that is arranged on a cross-arm 2 in accordance with FIG. 1 and that is formed as a pushing bar 4. The pushing bar 4 is mounted to a spring-absorber unit 7 on a first outer section 5 and on a second outer section 6. The spring-absorber unit 7 provides a movable connection between the pushing bar and the cross-arm 2, whereby the pushing unit 3 can be displaced in a first direction A against the spring rate of the spring-absorber unit 7 onto the cross-arm 2, but also can be pushed away from the cross-arm 2 in a second direction B by the spring-absorber unit 7. Even although it is not shown in FIG. 1, it is also possible for a plurality of spring-absorber units 7 to be arranged next to one another at equal distances or in sets along the pushing bar 4 in order to attach the pushing unit 3 to the cross-arm 2 in a movable manner.

The pushing bar 4 comprises the outer sections 5, 6 and a middle section 8 that rigidly connects the two outer sections 5, 6 to each other. A suspension jaw 9 is provided on the middle section 8, whereby said suspension jaw can be connected directly to a material supply vehicle (HGV) that is not shown or to the material supply vehicle by means of a spacing rod.

A guide section 10 is furthermore formed in the middle of the pushing bar 4, whereby this guide section movably holds the alignment protrusion 11 of the cross-arm 2. The alignment protrusion 11 is fixed in place vertically in an opening of the guide section 10. Naturally a plurality of guide sections 10 can be provided along the pushing bar 4 relative to the cross-arm 2 with alignment protrusions 11 held in a movable manner therein.

Docking elements 12 are furthermore arranged on the pushing unit 3. The docking elements 12 are provided as rotatably mounted push rollers and are rotatably mounted along the first section 5 and along the second section 6 of the pushing unit 3 essentially parallel to the sections 5, 6.

FIG. 1 furthermore shows articulated joints 13 that hold the pushing bar 4 in a movable manner on the spring-absorber units 7. The articulated joints 13 allow the pushing bar 4 to take on a skewed position relative to the cross-arm 2 if the pushing bar 4, particularly the docking elements 12, are not uniformly loaded.

Attachment elements 14 are furthermore provided on the cross-arm 2, whereby the pushing device 1 can be attached to the road paver or feeder vehicle 50 with these attachment elements. For example, the attachment elements are attached to the supporting vehicle 50 by means of a screwed connection that is not shown. In particular, the attachment elements 14 are formed as suspension eyes into which hook-like elements can engage during crane loading.

FIG. 2 shows the pushing device 1 relative to a hopper end 15 of a road paver or feeder vehicle 50. The pushing device 1 is shown relative to the width of a scraper conveyor tunnel 60 of the hopper end 15.

FIG. 2 likewise shows two spaced alignment links 16 that are arranged such that they jut out forward on a first outer end and on a second outer opposite end of the cross-arm 2 and that they extend across an upper edge of the first section 5 and of the second section 6 of the pushing bar 4 so that the pushing bar 4 is additionally fixed in place vertically. An exact guiding of the pushing bar 4 along the alignment links 16 is furthermore achieved so that a force targeted at the pushing bar 4 can be linearly transferred on to the spring-absorber unit 7.

FIG. 2 furthermore shows a sensor 18 integrated into the spring-absorber unit 7, whereby said sensor is connected to a controller 17. The controller 17 is formed for the purpose of receiving and evaluating signals from the sensor 18. The sensor 18 integrated into the spring-absorber unit 7 is capable of acquiring the entire range of the spring or individual spring positions of the spring-absorber unit 7 and to inform the controller 17 of the values resulting from said acquisition. The controller 17 is arranged directly on the spring-absorber unit 7, but can also be installed in the road paver or feeder vehicle 50. A warning device that is not shown but that is connected to the controller 17 can be used to convey a warning signal to the driver in either a visual or acoustic manner. A traffic light warning is provided for a visual warning while a horn is provided for an acoustic warning.

Figure 3:
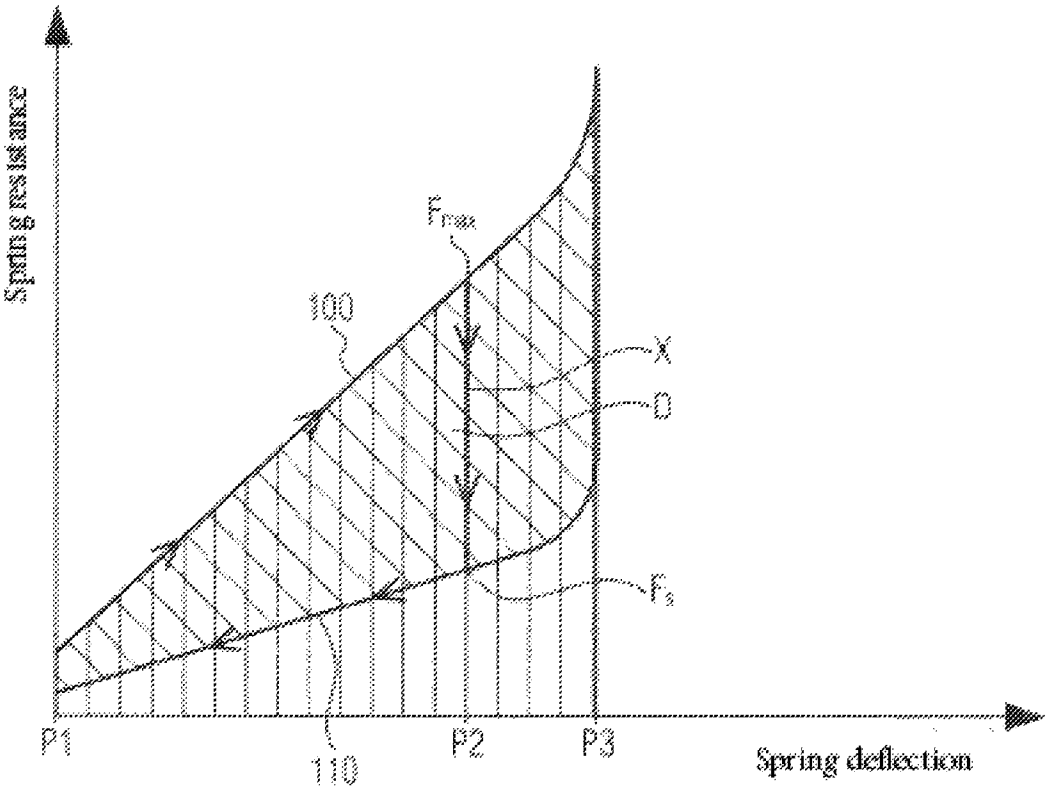

FIG. 3 shows a force-displacement diagram, which represents a loading of the spring-absorber unit 7 according to the invention between a first position P1 and a second position P2. The loading of the spring-absorber unit 7 along the path X marked in the direction of the arrow is shown in the force-displacement diagram.

In the diagram, a first characteristic curve 100 can be seen during a displacement of the spring-absorber unit 7 from the first position P1 into the second position P2. During a further displacement of the spring-absorber unit 7 in the first position, the characteristic curve 100 extends through the second position P2 and into a third position P3 that corresponds to a maximum range of the spring of the spring-absorber unit 7.

According to FIG. 3, a maximum contact force Fmax acts on the spring-absorber unit 7 in the second position P2. The maximum contact force Fmax occurs during the acceleration of the HGV if this docks against the spring-absorber unit 7 from a standing position, or during the delay of the HGV if it drives against the spring-absorber unit 7. The size of the contact force Fmax is, along with the HGV mass and the starting speed, materially determined by the delay or acceleration path of the HGV. Here, the smaller the delay or acceleration path, the greater the maximum contact force Fmax is.

FIG. 3 furthermore shows in a second position P2 a pushing force Fs that acts on the spring-absorber unit 7 for pushing the HGV at an essentially constant installation speed. The maximum contact force Fmax amounts to a multiple of the pushing force Fs.

A second characteristic curve 110 is drawn in below the first characteristic curve 100, whereby this second characteristic curve marks a return of the spring-absorber unit 7 along a second direction from the second position P2 to the first position P1. The work W performed is shown in cross-hatched columns between the first characteristic curve 100 and the abscissa of the diagram. An absorption area D is shown between the first characteristic curve 100 and the second characteristic curve 110 in a checked pattern.

The diagram consequently shows that a larger force acts on the spring-absorber unit 7 according to the invention when the pushing unit 3 is moved towards the cross-arm 2, meaning in the first direction along the first characteristic curve 100, than when the pushing unit 3 is moved away from the cross-arm 2 in the second direction along the second characteristic curve 110. This means that the spring-absorber unit 7 has a greater spring rate along the first characteristic curve 100 than along the second characteristic curve 110.

Figure 4:
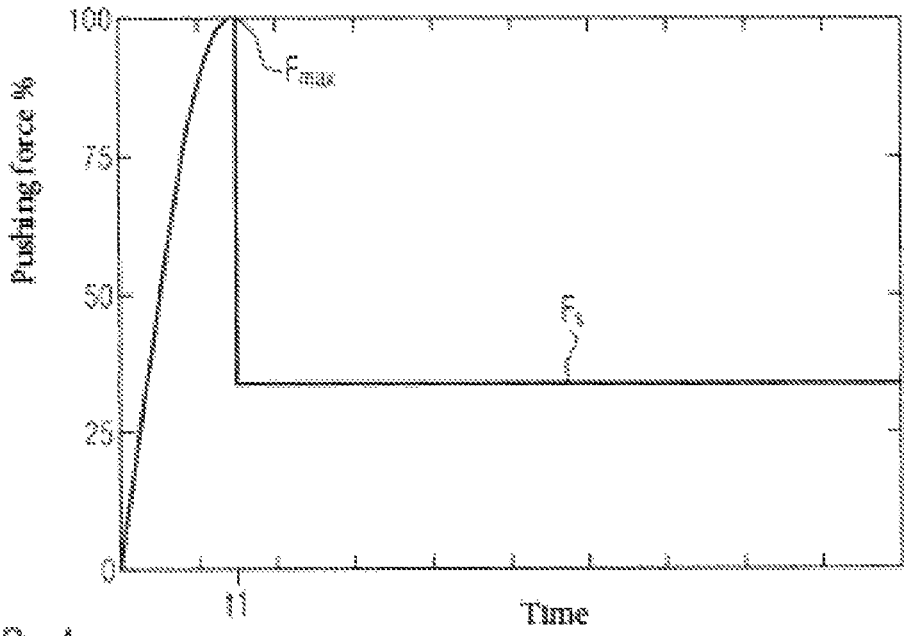

FIG. 4 illustrates an idealised force curve at the contact point between the HGV and the paver or the feeder vehicle during the docking procedure or after this procedure. In this, first the jump-like rise of the force up to the maximum contact force Fmax, which was already described in FIG. 3, is shown during the docking. The maximum contact force Fmax drops off at a point in time t1 to the pushing force Fs as soon as the HGV takes on the installation speed in the installation direction of the paver or the feeder vehicle.

Figure 5:
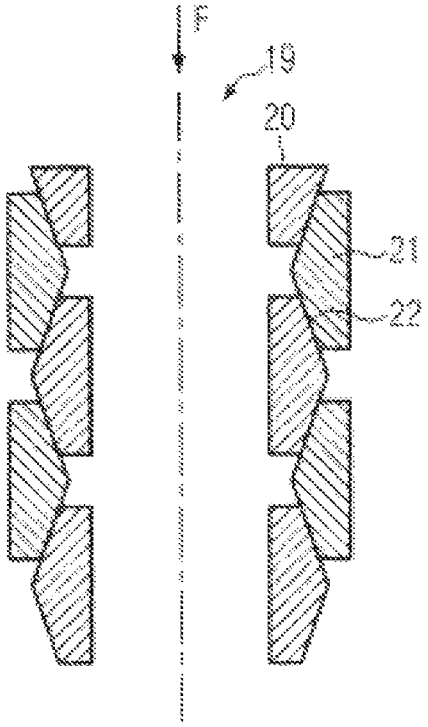

FIG. 5 shows a friction spring 19 in cross-section. The friction spring 19 comprises inner and outer rings 20, 21 which are arranged concentrically with respect to one another. The outer rings 21 comprise a larger diameter than the inner rings 20. The inner rings 20 and the outer rings 21 furthermore each comprise tapered surfaces 22. The tapered surfaces 22 of the inner rings 20 contact the tapered surfaces 22 of the outer rings 21. Under a force F on the friction spring 19, the outer rings 21 expand their diameters and the inner rings 20 reduce their diameters, in that the respective tapered surfaces 22 roll on one another. The tapered surfaces 22 thereby bring about a force and displacement transfer.

The invention claimed is:

1. Road paver or feeding vehicle with a pushing device comprising at least a pushing unit that is attached to a cross-arm of the road paver or feeder vehicle and movably held relative to the cross-arm by at least one cushioning spring-absorber unit that is movable from a first position P1 into a second position P2 when the pushing unit is pressed towards the cross-arm in a first direction and the at least one spring-absorber unit can be moved in a second direction from the second position P2 back into the first position P1 in order to press the pushing unit in a second direction away from the cross-arm, the at least one spring-absorber unit having a larger spring rate during a movement of the pushing unit in the first direction than in the second direction, wherein the at least one spring-absorber unit comprises at least a friction spring which comprises inner and outer rings arranged concentrically with respect to one another, wherein the at least one spring-absorber unit comprises at least a sensor coupled to a controller and integrated into the spring absorber unit, the sensor being formed for acquiring the position of the spring-absorber unit and/or for acquiring a distance between the cross-arm and the pushing unit and the controller outputs visual or acoustic signals for an operator of the road paver or feeder vehicle.

2. Road paver or feeding vehicle with a pushing device according to claim 1 wherein the spring-absorber unit is connected to the pushing unit by an articulated joint.

3. Road paver or feeding vehicle with a pushing device according to claim 2 wherein the articulated joint allows a skewed position of the pushing unit relative to the cross-arm.

4. Road paver or feeding vehicle with a pushing device according to claim 1 comprising two spring absorber units wherein the pushing unit comprises a first section that is attached to an outer first section of the cross-arm by one of the spring-absorber units and wherein the pushing unit comprises a second section that is attached to an outer, opposite section of the cross-arm by the other spring-absorber unit.

5. Road paver or feeding vehicle with a pushing device according to claim 4 wherein the first and second sections of the pushing unit are rigidly connected by a middle section in order to form a pushing bar.

6. Road paver or feeding vehicle with a pushing device according to claim 5 wherein the pushing bar is attached to the outer first section of the cross-arm by one of the spring-absorber units and to the outer, opposite section of the cross-arm by the other spring-absorber unit.

7. Road paver or feeding vehicle with a pushing device according to claim 5 wherein the pushing bar comprises a guide section in the middle that holds an alignment protrusion of the cross-arm in a movable manner.

8. Road paver or feeding vehicle with a pushing device according to claim 1 wherein at least one docking element is mounted on to the pushing unit.

9. Road paver or feeding vehicle with a pushing device according to claim 8 wherein the at least one docking element is a rotatably mounted push roller.

10. Road paver or feeding vehicle with a pushing device according to claim 1 wherein the cross-arm is attached to the at least one spring-absorber unit on the chassis of the road paver or feeder vehicle in a detachable or non-detachable manner.

11. Vehicle for receiving installation material, particularly a road paver or feeder with a pushing device according to claim 1.

12. Road paver or feeding vehicle having a pushing device comprising a pushing unit that is attached to a cross arm of the road paver or feeder vehicle and movably held relative to the cross arm by two spring-absorber units that are each movable from a first position P1 into a second position P2 when the pushing unit is pressed towards the cross arm in a first direction and the two spring-absorbers unit can be moved in a second direction from the second position P2 back into the first position P1 in order to press the pushing unit in a second direction away from the chassis component, the two spring-absorber units having a larger spring rate during a movement of the pushing unit in the first direction than in the second direction, wherein each of the two spring-absorber units comprises at least a friction spring having inner and outer rings arranged concentrically with respect to one another and wherein the pushing unit comprises a first section that is attached to an outer first section of the cross-arm by one of the two spring-absorber units and a second section that is attached to an outer, opposite section of the cross-arm by the other one of the spring-absorber units, and the first and second sections of the pushing unit are rigidly connected by a middle section in order to form a pushing bar and wherein the two spring-absorber units each comprise at least a sensor coupled to a controller and integrated into the spring absorber units, the sensor being formed for acquiring the position of the spring-absorber units and/or for acquiring a distance between the cross-arm and the pushing units, and the controller being formed for the purpose of outputting visual or acoustic signals for the operator of the road paver or feeding vehicle.

13. Road paver or feeding vehicle with a pushing device comprising at least a pushing unit that is attached to a cross-arm of a road paver or feeder vehicle and movably held relative to the cross-arm by at least one cushioning spring-absorber unit that is movable from a first position P1 into a second position P2 when the pushing unit is pressed towards the cross-arm in a first direction and the at least one spring-absorber unit can be moved in a second direction from the second position P2 back into the first position P1 in order to press the pushing unit in a second direction away from the cross-arm, the at least one spring-absorber unit having a larger spring rate during a movement of the pushing unit in the first direction than in the second direction, wherein the at least one spring-absorber unit comprises at least a friction spring which comprises inner and outer rings arranged concentrically with respect to one another and wherein the at least one spring-absorber unit comprises a sensor that is formed for acquiring at least one of the position of the spring-absorber unit or a distance between the cross-arm and the pushing unit and wherein the sensor is coupled to a controller that outputs visual or acoustic signals for the operator of the road paver or feeding vehicle.

* * * * *